United States Patent [19]

Wainwright

[11] 4,349,008

[45] Sep. 14, 1982

[54] APPARATUS FOR PRODUCING SPARK IGNITION OF AN INTERNAL COMBUSTION ENGINE

[76] Inventor: Basil E. Wainwright, 80 Greenaleigh Rd., Yardley Wood, Birmingham B14 4JE, England

[21] Appl. No.: 93,135

[22] Filed: Nov. 9, 1979

[51] Int. Cl.[3] ..... F02P 1/00

[52] U.S. Cl. ..... 123/620; 123/598; 123/606; 123/621; 123/626; 123/630; 331/113 A

[58] Field of Search ..... 123/596, 598, 606, 607, 123/620, 625, 626, 628, 640, 654, 655, 624; 331/62, 112, 113 A

[56] References Cited

U.S. PATENT DOCUMENTS

| | | | |
|---|---|---|---|
| 2,807,729 | 9/1957 | Redick | 123/624 |
| 3,173,410 | 3/1965 | McLaughlin | 123/624 |
| 3,270,731 | 9/1966 | Mieras | 123/624 |
| 3,718,124 | 2/1973 | Burley | 123/624 |
| 3,818,885 | 6/1974 | Canup | 123/606 |
| 3,906,919 | 9/1975 | Asik | 123/606 |
| 3,961,613 | 6/1976 | Canup | 123/598 |
| 3,973,545 | 8/1976 | Fischman | 123/598 |
| 4,033,316 | 7/1977 | Birchenough | 123/598 |
| 4,069,801 | 1/1978 | Stevens | 123/598 |
| 4,136,301 | 1/1979 | Shimojo | 123/598 |

*Primary Examiner*—Ronald B. Cox

*Attorney, Agent, or Firm*—Laubscher, Philpitt & Laubscher

[57] ABSTRACT

Apparatus for producing spark ignition of an internal combustion engine in which sparks at the spark plugs are initiated by a high voltage pulse of typically 20 KV and are sustained thereafter by a d.c. voltage of typically 3 KV. In one embodiment the d.c. voltage is produced from a 12 volt supply by a d.c. to d.c. converter, the converter being adapted to produce a substantially constant voltage irrespective of the current drain produced by the spark, within given limits. The converter is also adapted to shut down its operation in the event of an output short circuit. The converter is disclosed connected to a lean burn PROCO engine with the result that only one spark plug per cylinder is required. In an alternative embodiment the d.c. sustaining voltage is derived directly from a conventional alternator driven by the engine.

21 Claims, 15 Drawing Figures

PRIMARY INPUT
TO DISTRIBUTOR
FUNCTION INDICATOR
12V
1
1a
1b
6
7
8
9
10
11
11a
11b
12
13
14
20
T1
R1
R2
R3
C1
C2
C3
C4
C5
C6
D1
D2
D3
D4
L1
CT
TR1
TR2

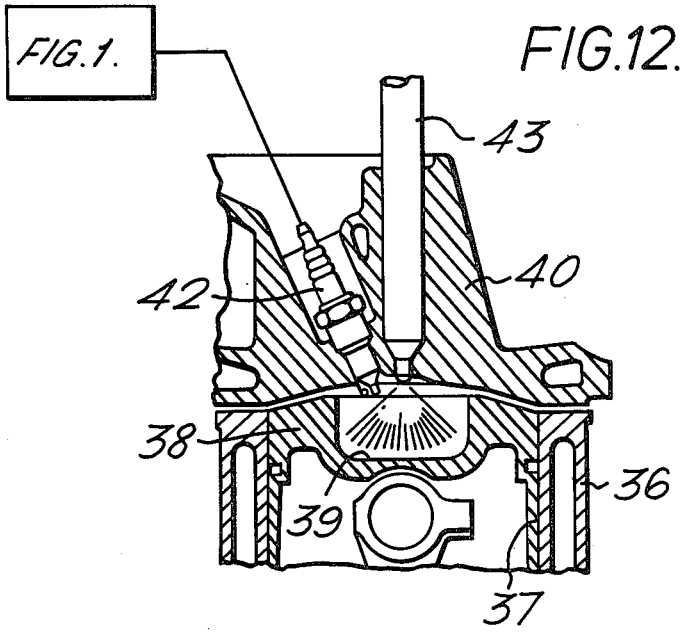
FIG.1.
FIG.12.
43
40
42
38
39
36
37
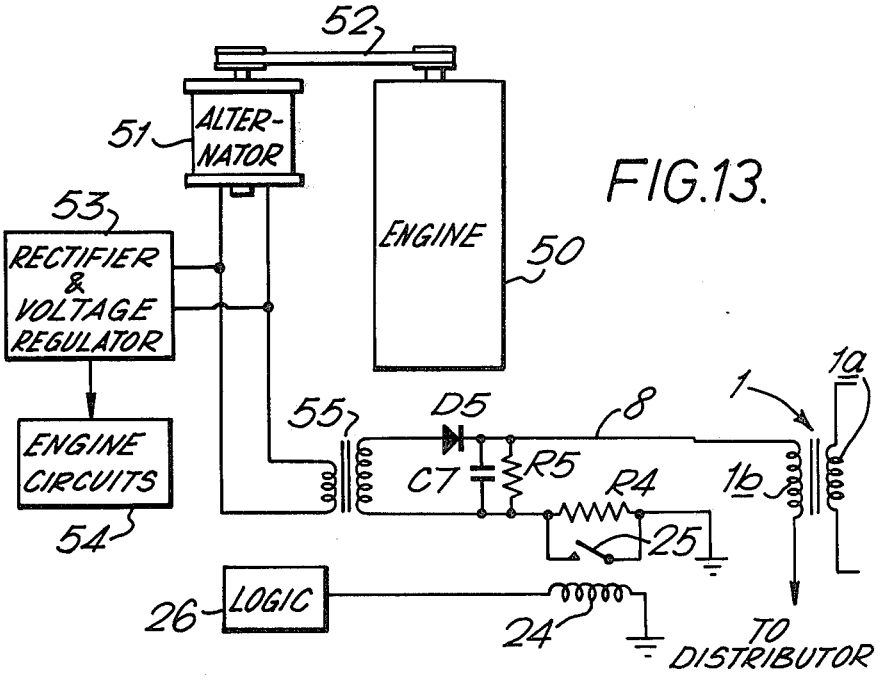
52
51
ALTER-
NATOR
FIG.13.
53
RECTIFIER
&
VOLTAGE
REGULATOR
ENGINE
50
ENGINE
CIRCUITS
54
55
D5
8
1
1a
C7
R5
R4
1b
25
26
LOGIC
24
TO
DISTRIBUTOR

APPARATUS FOR PRODUCING SPARK IGNITION OF AN INTERNAL COMBUSTION ENGINE

FIELD OF THE INVENTION

This invention concerns improvements in and relating to apparatus for producing spark ignition of an internal combustion engine, and is particularly but not exclusively concerned with engines for automobiles.

BACKGROUND TO THE INVENTION

It is well known that the electrical sparks fed to the spark plugs of an internal combustion engine are usually produced by means of an ignition coil having its high voltage secondary winding connected to the engine's spark plug through a distributor, the coil having its primary winding connected to a low voltage source, typically a 12 volt battery or an alternator system driven by the engine. An engine driven switching device, typically a mechanical contact breaker produces interruptions in the current flowing the primary winding of the coil and consequentially high voltage pulses are produced in the secondary winding, which are applied to the spark plugs.

Considerable research has been directed at improving fuel economy and reducing pollutant emission of internal combustion engines. Efforts have been made to devise an engine which will run satisfactorily with a leaner fuel to air ratio fed to the cylinders of the engine. Such a leaner fuel to air ratio reduces fuel consumption but has the disadvantage that the fuel/air mixture becomes more difficult to ignite with a conventional spark ignition system. Also, the increased ratio of air to fuel increases the likelihood of nitrogenous fuel constituents being converted by the combustion into oxides of nitrogen, hereinafter referred to as $NO_x$. Such $NO_x$ products are difficult to extract from the exhaust of the engine, as is necessary if the engine is to comply with pollutant emission regulations.

In order to reduce $NO_x$ exhaust emission, recent research has been directed to recirculating engine exhaust gases into the engine's cylinders so as to reduce the ratio of fuel to air in the mixture to be consumed in the engines, whilst maintaining a lean fuel content in the mixture. Such exhaust gas recirculation, hereinafter referred to as EGR, reduces $NO_x$ emission but cools the temperature of combustion and makes the combustible mixture in the engine's cylinders even more difficult to ignite.

Various proposals have been made to overcome the difficulties of igniting a lean fuel/air mixture. One solution involves the redesign of the engine such as to produce a so-called stratified charge in the cylinders. In a stratified charge engine, a fuel/air mixture has a non uniform spatial fuel distribution within the cylinder such that a higher concentration of fuel occurs adjacent the spark plug than in the most part of the cylinder. When spark ignition occurs, combustion will occur more readily in the relatively high fuel concentration adjacent the spark plug and the ensuing heat of combustion will cause the combustion to spread to the leaner mixture in the other parts of the cylinder. One example of a stratified charge engine is described in "A New Concept of Stratified Charge Combustion—The Ford Combustion Process (FCP)"SAE Paper No. 680041 January 1968. This engine was developed into the PROCO engine described in "The Ford PROCO Engine Update" SAE Paper No. 780699 August 1978. It will be seen that in contrast to the FCP engine, the PROCO engine has an EGR system to reduce $NO_x$ exhaust emissions. Moreover it is to be noted that in order to achieve satisfactory combustion, two spark plugs per cylinder are required with the EGR assisted PROCO engine, thus illustrating the further difficulties that occur in initiating ignition of a lean burn mixture when EGR is used. It will be appreciated that when two spark plugs per cylinder are used, a complex distributor is required and the overall cost of the ignition system is increased substantially. Another problem resulting from the use of two spark plugs per cylinder is that the PROCO engine concept can only be used for large engine capacities of typically 5 liters or more. For smaller engine capacities, there is not enough room in the cylinder head to receive the spark plugs and the necessary valves and injectors used for this type of engine.

Another proposal for igniting a fuel/air mixture is shown in U.S. Pat. No. 4,033,316 to Birchenough, that discloses an arrangement in which a high voltage direct current source is connected in series with the secondary winding of an ignition coil, in such a manner as to maintain the spark initiated by the conventional operation of the coil. Thus, the spark ignition in the cylinder is initiated by a typically 20 KV pulse produced in a conventional manner by interrupting the current flow in the coil's primary winding, and the spark is thereafter maintained by a high voltage of typically 2 to 4 KV from the high voltage d.c. source that is connected in series with the coil's secondary winding, in a manner broadly analogous to the way in which a welding arc is initiated by a high voltage pulse and is sustained by a lower voltage direct current. It is well known that once an arc has been struck it can be maintained by a voltage less than that required to strike the arc.

Birchenough states that the voltage required to sustain the spark is generally constant, and that the voltage current characteristic of the direct current generator should be such as to deliver a constant current to the spark.

The circuit shown in FIG. 2 of the Birchenough U.S. patent achieves this condition by arranging the d.c. generator to have an output voltage current characteristic defined by a curve for which a decreased output voltage results in an increased current, the maximum current at low voltage being limited by the output impedance of the d.c. generator.

I have found that in practice, whilst the voltage required to sustain the arc does have a generally constant mean value, it is subject to transistory fluctuations, these fluctuations occurring during combustion conditions of high EGR, high compression, high gas swirl rates within the cylinder, and extremely lean burn fuel mixtures. During such a transistory fluctuations both a relatively high voltage and current may be required to sustain the spark. However, the d.c. generator of Birchenough delivers a relatively low voltage at high current levels and accordingly will not sustain the spark during such transitory conditions unless the d.c. generator is made more powerful and accordingly inefficient for the most part of its operation.

Another problem occurs with the d.c. generator of Birchenough in the event that a short circuit occurs across the spark plug or across the output of the generator. Such a short circuit condition could occur when an engineer is checking operation of the ignition circuit. It is common practice to touch the spark plug's lead against the engine to see if a spark jumps from the end of the lead. During such testing a short circuit is likely to occur across the output of the d.c. generator. Now, the d.c. generator of Birchenough comprises a free running oscillator which drives a step up transformer, the output of which is applied to a diode and capacitor network which acts as a rectifier and voltage multiplier, to develop a high voltage d.c. output across an output capacitor. In the event of a short circuit across the output, the d.c. generator operates to pump a high current into the short circuit. As a result the oscillator will overheat and is likely to fail. The circuit of Birchenough is accordingly dangerous to maintenance engineers. If an engineer accidentally touches the high voltage spark plug lead, to produce a short circuit, the d.c. generator will pump a heavy current into the short, with consequential hazardous results for the engineer.

Another problem with the Birchenough circuit is that the operation of the high voltage d.c. source produces substantial erosion rates of the spark plugs' electrodes and the electrodes of the distributor and its associated rotor arm. This problem is particularly serious if the energy supplied by the d.c. generator is selected to be high enough to maintain the spark during combustion with high EGR rates and high combustion gas swirl for lean burn fuel mixtures.

A further problem with the Birchenough circuit is that the output capacitor of the d.c. generator will remain charged for a substantial time after the circuit has been switched off. Thus, if an engineer touches the output of the ignition circuit even after the circuit has been switched off, he is liable to receive an electric shock.

OBJECTS AND SUMMARY OF THE INVENTION

It is an object of the invention to provide an improved ignition system for a lean burn engine.

It is another object of the invention to provide an ignition system that will provide satisfactory combustion of an internal combustion engine provided with an EGR system.

It is a further object of the invention to provide an ignition system in which the sparks produced by the spark plugs are initiated by the conventional operation of an ignition coil and are thereafter sustained by the use of a d.c. generator, the d.c. generator being so adapted as to sustain the sparks even during the aforesaid transitory arc sustaining voltage and current fluctuations.

It is yet another object of the invention to provide such a d.c. generator which does not pump heavy current into an output short circuit, and which is less likely to produce dangerous electrical shocks to maintenance engineers.

A further object of the invention is to provide a stratified charge internal combustion engine having an EGR system, with an ignition system including only one spark plug per engine cylinder.

Yet another object of the invention is to provide a PROCO engine with an ignition system having only one spark plug per cylinder.

Yet a further object is to provide an ignition system which aids in permitting smaller size PROCO engines to be constructed.

From one aspect the invention provides an apparatus for producing spark ignition of an internal combustion engine in which sparks across the spark plugs are initiated by an electrical pulse and are thereafter sustained by the use of a d.c. generator which applies a sustaining voltage to the plugs, the generator being characterized in that it is adapted to produce a substantially constant voltage over a predetermined range of current values supplied thereby to sustain the spark, and to cease operation capable of sustaining the spark in the event that the current supplied thereby to the spark plug exceeds a predetermined maximum value. The d.c. generator has the advantage that because the voltage thereof remains substantially constant, the generator will sustain sparks even under conditions of high EGR, gas swirl load and extremely lean burn. If the spark demands a transitory high current, the voltage of the generator can deliver the current without the voltage dropping below the arc sustaining voltage.

Also, because the generator will cease operation when the current exceeds a given maximum value thereof, the generator will not pump a heavy current into a short circuit, and thus dangers to maintenance engineers who accidently touch the spark plug leads, are reduced substantially. Also, in the event of an output short circuit, the generator will not overheat or fail.

In accordance with a preferred feature of the invention, the d.c. generator develops its output voltage across a capacitor which is shunted by resistance elements to allow the capacitor to discharge when the generator is inoperative. In this way, the capacitor will dissipate the charge which might otherwise give an electrical shock to a maintenance engineer.

From another aspect the invention provides an apparatus for producing spark ignition of an internal combustion engine in which the spark sustaining voltage produced by the d.c. generator is of a selectively variable level, the level being alterable in dependence upon operating parameters of the engine, with the advantage that relatively high spark energies need only be used for extreme combustion conditions and lower spark energies can be used at other times, so that spark plug electrode erosion is reduced.

From yet another aspect the invention provides an improved ignition system on a stratified charge lean burn engine, particularly but not exclusively a PROCO engine, in which sparks across spark plugs in combustion chambers in the engine are initiated by electrical pulses and are thereafter sustained by the use of a d.c. generator which applies a spark sustaining voltage to the plugs. In accordance with this aspect of the invention only one spark plug per combustion chamber is provided, since in accordance with my invention satisfactory ignition can be achieved with only one spark plug, without any reduction in fuel economy and with an improvement in exhaust pollution reduction. Furthermore, with my invention the stratified charge engine can operate at high EGR rates without the occurrence of substantial harsh running.

Further features objects and advantages of my invention will appear from the following description of embodiments thereof given by way of illustrative example with reference to the accompanying drawings.

BRIEF DESCRIPTION OF THE DRAWINGS

FIG. 3 shows waveforms illustrative of operation of the d.c. generator.

FIG. 12 is a schematic sectional view of a PROCO engine adapted to have an ignition system according to the invention, and which has only one spark plug per cylinder; and FIG. 13 is a schematic diagram of another example of the invention which utilizes a conventional alternator.

DESCRIPTION OF PFREFERRED EMBODIMENTS

Figure 1:
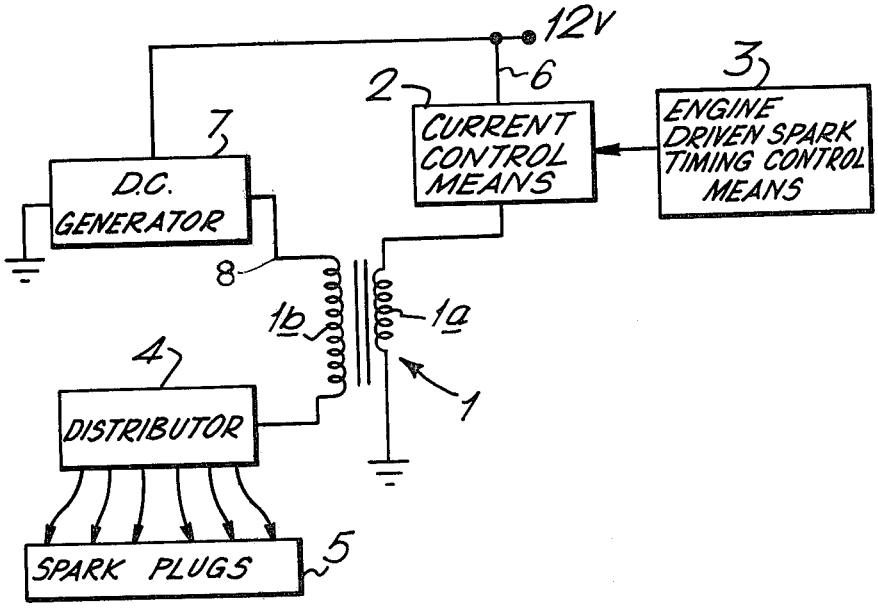
FIG. 1 is a schematic diagram of an apparatus for producing spark ignition in accordance with the invention.

Referring to FIG. 1 there is shown a spark pulse generating means which includes an ignition coil 1, having primary and secondary windings 1*a*, 1*b*, a current control means 2 which controls a low voltage current flowing in the primary winding, and an engine driven spark timing control means 3 which drives the current control means 2. The current control means 2 is adapted to produce a rapid rate of change of current flow in the primary winding 1*a* in response to operation of the timing control means 3, so as to induce in the secondary winding 1*b* a high voltage pulse of typically 20–40 KV. This high voltage pulse is capable of producing spark ignition in an internal combustion engine and the pulse is applied through a distributor 4 which may be any of the well known types, to spark plugs 5 installed in cylinders of the engine (not shown).

The current control means 2 and the timing control means 3 may be constituted by a conventional contact breaker driven by a cam in the distributor 4, which switches a nominally 12 volt supply from the engine's usual battery/alternator arrangement (not shown) on line 6, to interrupt the current flow and produce a rapid rate of change of current in the primary 1*a*. Alternatively, the current control means can be a semiconductor switch, which may operate to discharge a capacitor through the primary winding 1*a*. Also, the spark timing control means 3 may be constituted by a known photoelectric, infra-red or like detector responsive to the angular position of rotation of the engine.

Thus, in operation of the spark generating means, high voltage pulses are produced in the coil's secondary winding 1*b* in response to successive operations of the spark timing control means 3, these pulses being appropriately applied by the distributor 4 to successive ones of the spark plugs 5 so as to establish sparks in successive ones of the cylinders and thereby ignite fuel/air mixture in the cylinders.

Additionally, a d.c. generator 7 is provided, connected in series with the secondary winding 1*b*. The generator 7 applies to the spark plugs 5 a d.c. voltage capable of sustaining a spark across the spark plugs after the high voltage spark initiating pulse produced by operation of the circuit 2 has died away to a level incapable of maintaining the spark. The d.c. generator 7 comprises a d.c. to d.c. converter arranged to generate a high voltage output of nominally 3 KV from the low voltage supply on line 6. The generator 7 produces a rectified d.c. output on line 8, which is fed through the secondary 1*b* of the coil to the distributor 4 and hence to the spark plugs 5. The output voltage of the generator 7 is of a magnitude selected to sustain but not initiate a spark across one of the spark plugs 5, and the generator is per se capable of producing a continuous voltage of such a magnitude. Once the spark has been initiated by a high voltage pulse produced by operation of the current control means 2, the spark can be sustained by a somewhat lower voltage, and the d.c. generator 7 is suitable for providing such a sustaining voltage. The fact that the spark sustaining current is supplied by a separate generator 7 provides the advantage of allowing much greater spark currents to be established for longer periods of time, which provides for improved fuel burning and results in improved fuel economy and/or a reduction in pollutant emission.

In the forms of the invention described herein the generator 7 develops a continuous output voltage and each spark is extinguished either by operation of the distributor to disconnect the applied sustaining voltage and connect it to a subsequent spark plug, or by virtue of the increased gas pressure produced in the cylinder by the combustion initiated by the spark. The increased gas pressure presents an increased electrical impedance to the arc established between the spark plug electrodes, and the voltage level produced by the generator 7 can be appropriately selected so that the increased gas pressure will cause the spark automatically to extinguish when the gas pressure rises to a given level indicating that satisfactory combustion has occurred in the cylinder. Thus, when the given pressure level is reached in the cylinder, the voltage produced by the generator 7 is insufficient to maintain the spark, and the spark will terminate automatically.

In an alternative arrangement, the d.c. generator 7 is switched off and on again so as to terminate the spark.

Because the generator 7 is per se capable of producing a continuous high voltage output, the period that the generator 7 can be switched to supply the spark sustaining voltage to the sparks, can be selected independently of the characteristics of the circuit of the generator 7 and thus the duration of the output voltage can be selected for example to be from a few milliseconds to an effectively infinite duration. This arrangement allows the spark duration to be controlled independently of the characteristics of the circuit, and allows the current flowing through the arc established across the spark plug to be substantially constant during the entire period that the spark is sustained by the voltage from the generator 7. Accordingly, the system of the invention allows the spark duration to be extended and energy to be increased which improves engine combustion.

Figure 2:
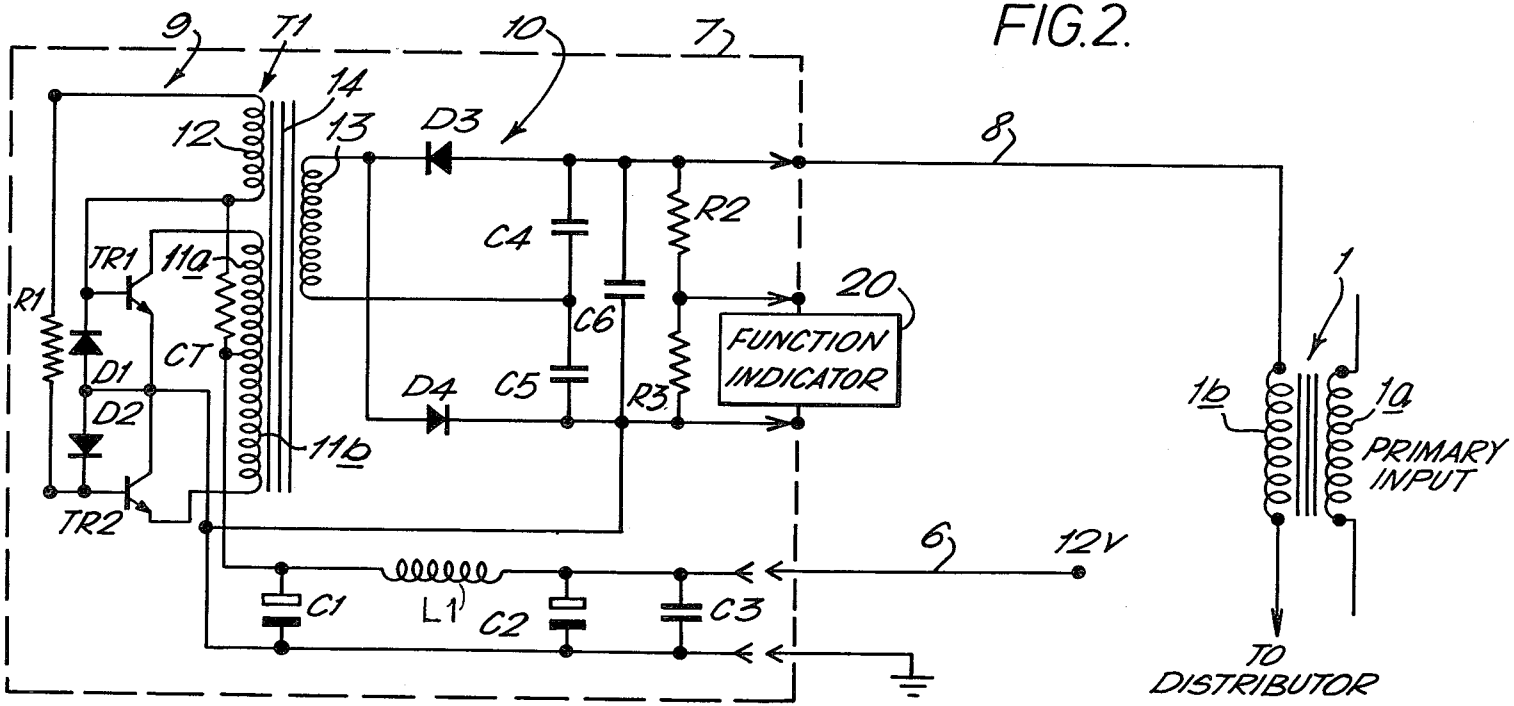
FIG. 2 illustrates in more detail the circuit diagram of a d.c. generator shown in FIG. 1.

The d.c. to d.c. converter circuit of the generator 7 will now be described in more detail with reference to FIG. 2. The circuit of the generator 7 is shown within a hatched outline and its interconnections to the rest of the ignition circuit are shown schematically. The circuit comprises an oscillator stage 9 which drives a step up transformer T1, the output of the transformer being fed to a voltage multiplier and rectifier stage 10.

The oscillator stage 9 is powered from the low voltage 12 volt supply line 6 through an interference filter network comprising capacitors C1 to C3 and an inductor L1. The filter network prevents spurious transients on the line 6 from distributing the oscillatory condition of the oscillator stage 9. The transformer T1 has a primary winding with winding portions 11*a*, 11*b* and a centre tap CT, a feedback winding 12, a secondary winding 13 and a saturable core 14. Transistors TR1 and TR2 are arranged to control the current flowing from the rail 6 in the primary winding portions 11*a*, 11*b* respectively, the bases of the transistors receiving a bias switching voltage derived from the feedback winding 12, through a biasing resistor R1 and diodes D1 and D2.

Figure 3A:
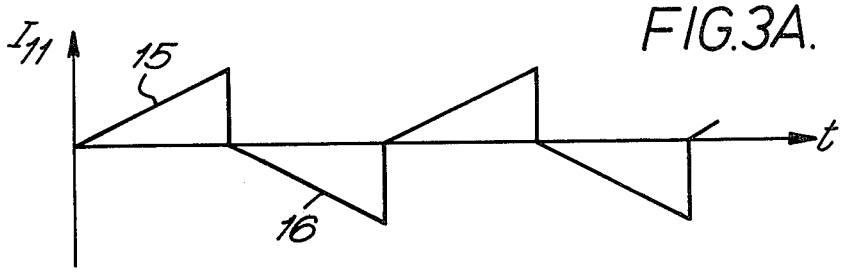
FIG. 3A showing the current in the primary winding of the transformer T1 of FIG. 2.
Figure 3B:
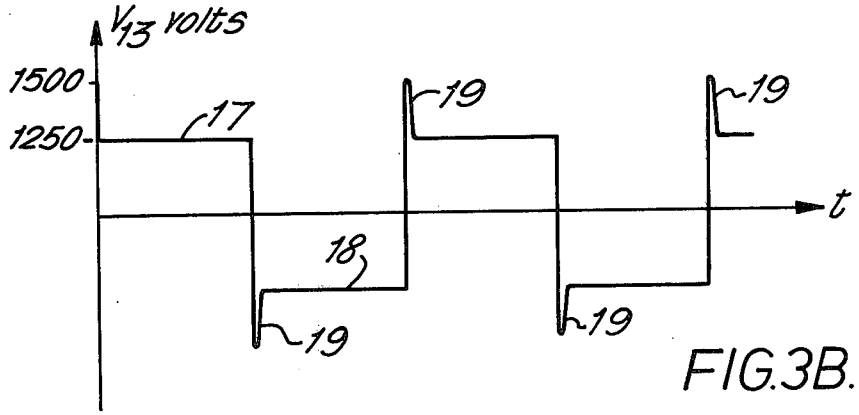
FIG. 3B showing the voltage induced in the secondary winding of the transformer T1.

Operation of the oscillator will now be described with reference to the waveform diagrams of FIGS. 3A and 3B. Assume that the transistor TR1 is conducting. A current flows from the line 6 through the winding portion 11*a* from the centre tap CT, the current building up substantially linearly at a rate determined substantially by the inductance of the winding portion 11*a*. The resulting current ramp in the winding portion 11*a* is shown at 15 in FIG. 3A. The effect of this substantially constant rate of change of current in the winding is to induce in the feedback winding a generally constant voltage which is of such a polarity to bias the base of transistor TR1 appropriately to hold the transistor in a conducting state. As the current flowing in the winding portion 11*a* builds up, the core 14 becomes saturated with magnetic flux, and the current can increase no further. As a result the voltage across the feedback winding rapidly collapses, and the bias voltage to the transistor TR1 decreases, which decreases the current flow in the winding portion 11*a*, thereby inducing an opposite polarity bias voltage across the feedback winding 12. This opposite polarity bias voltage rapidly switches on transistor TR2 and turns off the transistor TR1. The current then builds up in an opposite sense in the winding portion 11*b* until the core 14 saturates, in the manner shown at 16 in FIG. 3A, at which time transistor TR1 will again switch on and transistor TR2 will switch off. The circuit will oscillate in this matter. The current ramps such as 15 and 16 induce in the transformer secondary winding respective positive and negative voltages, such as 17 and 18 shown in FIG. 3B, the voltages being stepped up relative to the voltage applied to the primary winding portions 11 in dependence of the turns ratio of the primary winding portions and secondary windings 11, 12. Under a no load condition for the converter 7, switching transients occur in the oscillator which result in voltage spikes 19 (FIG. 3B) occurring on the voltage waveform of the secondary winding 12.

The voltage multiplier and rectifier 10 comprises fast recovery diodes D3, D4 which respectively pump charge into series connected capacitors C4, C5 during opposite polarities of the voltage on the winding 13. Thus, when the output voltage across winding 13 is positive diode D4 conducts and charges capacitor C5, and when the output voltage is negative capacitor C4 is charged through diode D3. Since the capacitors are series connected, the output across both of them constitutes a doubling of the positive voltage swing across the winding 13. A final output capacitor C6 is connected in parallel with the capacitors C4, C5 for smoothing purposes. Connected in parallel with the final output capacitor is a resistor chain R2, R3 which contributes to smoothing the output and which also provides a discharge path for the final output capacitor C6. A function indicator 20, typically a neon tube, is connected in parallel with the resistor R3 to indicate that the generator 7 is operative.

Figure 3C:
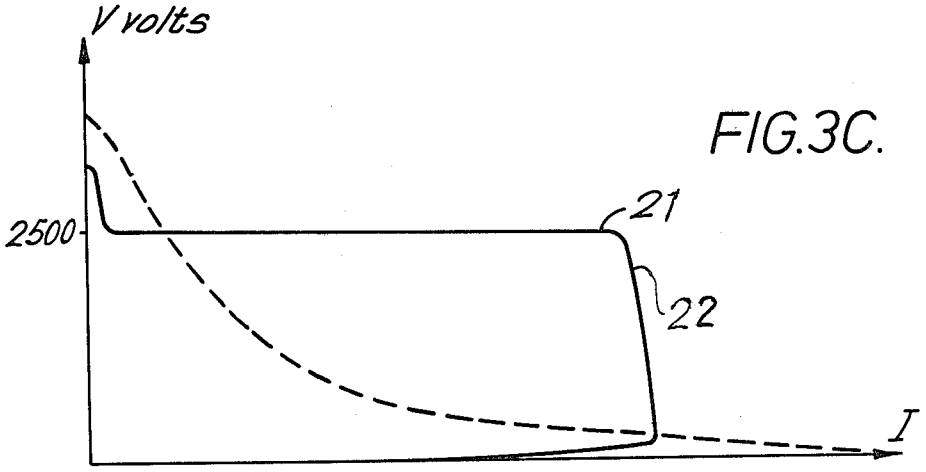
FIG. 3C illustrating the voltage current output characteristic of the generator 7.

The voltage current characteristic of the output of the generator 7 that is fed to the line 8, is shown in FIG. 3C as a curve 21. It will be seen that the generator 7 delivers a substantially constant voltage over a predetermined range of current. Thus when a spark is struck across a spark plug 5, the generator 7 will maintain a constant voltage irrespective of the current demand defined by the impedance of the arc, up to a maximum value of current 22 (FIG. 3C). The current value 22 is defined by the point at which the bases of TR1 and TR2 no longer saturate, this being adjustable by adjusting the value of resistor R1. Currents above the value 22 indicate a short or other fault condition at the spark plug, and the generator is arranged to shut down operation automatically if such a condition occurs. The occurrence of such a short circuit is reflected back to the output winding 13 of the transformer T1 (FIG. 2) such as to alter the inductance of the transformer and prevent the oscillator 9 from working. Another useful feature of the generator 7 can be seen from FIG. 3C. Before a spark is struck across one of the spark plugs, substantially no current is drawn on line 8 from the generator 7. Under such a condition, the capacitor C6 (FIG. 2) becomes charged to a voltage substantially equal to twice the value of the voltage spikes 19. This relatively high voltage from the generator 7 aids in striking the sparks at the spark plugs 5, since this voltage adds itself to the high voltage pulses induced in the secondary winding 1*b* of the coil. After the spark has been struck, current is drawn from the generator 8 and the voltage spikes 19 become integrated by the capacitors C4 to C6 with the result that output voltage on line 8 drops onto a substantially constant plateau depicted in FIG. 3C, and which is substantially equal to twice the voltage level the waveform 17 (FIG. 3B).

The voltage current characteristic of the generator 7 has the advantage of enabling the generator to sustain the spark under conditions of extreme lean burn combined with substantial rates of EGR and gas swirl within the cylinders of the engine. Under such conditions the impedance of the arc can undergo substantial transitory fluctuations, so as to draw an increased current from the generator 7. I have found that to sustain the arc in these extreme conditions, the generator must be able to deliver an appropriate current to the arc without allowing the voltage applied to the arc to drop. If the voltage drops below a certain level, even momentarily, the arc will become extinguished and will not be re-kindled unless another 20 KV pulse is applied from the ignition coil. In FIG. 3 there is shown in hatched outline the voltage current characteristic of generators of the type described in the prior Birchenough U.S. Pat. No. 4,033,316. It will be seen that if the arc momentarily demands a relatively high current, the voltage applied by the generator will drop. Thus, the arc would either become extinguished or if the generator of Birchenough were designed to operate satisfactorily under these conditions, it would consume much more power and would normally deliver unnecessarily high voltages to the spark plugs.

It is to be noted that the generator 7 has a low component count and is therefore cheap to produce and more reliable.

Another advantage of the generator 7 is that in the even of an engineer touching the spark plug lead to produce a short circuit, the oscillator 9 of the generator becomes damped and ceases operation. In this way a condition is avoided in which the generator pumps a heavy current into the short circuit. Clearly such a condition would be hazardous to the engineer and would also be likely to cause the generator to overheat and fail.

A further safety feature of the generator 7 is that the output capacitor C6 (FIG. 2) is shunted by resistors R2, R3 so that its charge can dissipate when the engine is turned off.

Without this shunt the capacitor C6 would retain its charge for a considerable period of time so that if an engineer was to work on the engine, he could receive an electric shock from the capacitor C6 through the ignition leads. Also with the present generator 7, the neon 20 will readily indicate to him not only if the system is operative but also if a charge remains on the capacitor C6.

Figure 4:
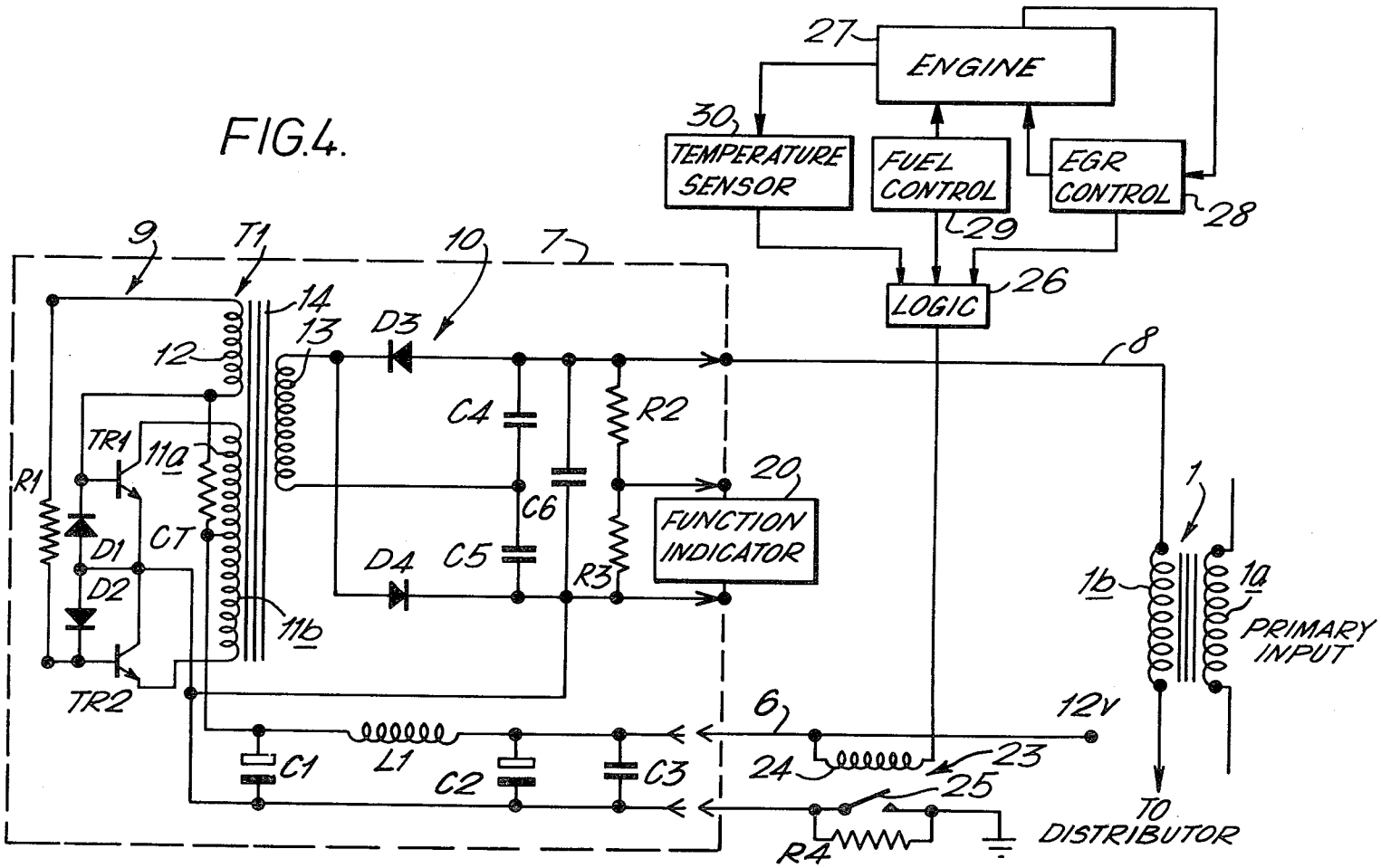
FIG. 4 illustrates a modification of the apparatus of FIGS. 1 and 2 in which the voltage produced by the generator 7 is controlled in dependence on operating parameters of the engine to reduce spark plug erosion.

A feature of the ignition system just described is that substantially increased mean spark energies are achieved compared with a conventional contact breaker ignition by means of the currents injected into the sparks by the generator 7. When substantial EGR or extreme lean burns are utilized in an engine, the spark energies need to be substantial if reliable ignition is to be achieved. A disadvantage that can occur is that the increased spark energies can cause unacceptable erosion rates of the spark plug electrodes and the electrodes of the distributor 4. In accordance with a feature of my invention the energy level of the sparks can be selected in dependence upon operating parameters of the engine such that higher energy sparks are only produced when extreme conditions occur. In this way, the mean energy of the sparks can be reduced without detracting from the improved engine running characteristics that result from the invention. An example of such an arrangement is shown in FIG. 4. This Figure shows the generator 7 coupled in series to the ignition coil, much as shown in FIG. 2, but additionally shows a relay 23 which is used to switch the voltage applied to the oscillator 9. The relay 23 has a coil 24, and contacts 25 which are shunted by a voltage dropping resistor R4. Normally the contacts 25 are open as shown in the drawing, such that a portion of the 12 V supply to the oscillator 9 is dropped across the resistor R4, thereby reducing the voltage developed across the primary winding 11 to a value less than 12 volts. As a result the high voltage d.c. output developed on line 8 is reduced below its maximum value. However, when the contacts 25 of the relay close, the resistor R4 is shorted out and the voltage applied to the oscillator 9 increases with the result that the d.c. output voltage on line 8 achieves its maximum value.

The relay is controlled by a logic circuit 26 which typically provides a switching path to earth for current to flow through the relay coil 24. The logic circuit is responsive to sensed operating parameters of the engine shown schematically at 27. The logic circuit 26 determines when operating parameters of the engine indicate that extreme combustion conditions occur, and the circuit 26 switches the relay 23 accordingly. As shown in FIG. 4, the engine is provided with an EGR system in which the gas flow rate is controlled selectively by a control 28. As will be appreciated by those skilled in the art the EGR rate is typically controlled as a function of inlet manifold vacuum level. The logic circuit 26 is responsive to the EGR rate.

The logic circuit 26 is also responsive to a fuel control 29 which determines the fuel mixture strength. In an engine aspirated by a conventional carburettor, the logic circuit would be responsive to the setting of the conventional choke whereas with a stratified charge engine provided with fuel injectors, the flow rate of fuel to the injectors would be monitored.

The logic circuit 26 is also responsive to the engine temperature as sensed by a temperature sensor 30. Thus, when these parameters jointly or severally define a condition known to represent extreme combustion conditions, the relay 23 is switched to provide a maximum output voltage on line 8, but otherwise the output voltage is switched to a lower level, with a consequential minimization of spark plug electrode erosion.

Figure 5:
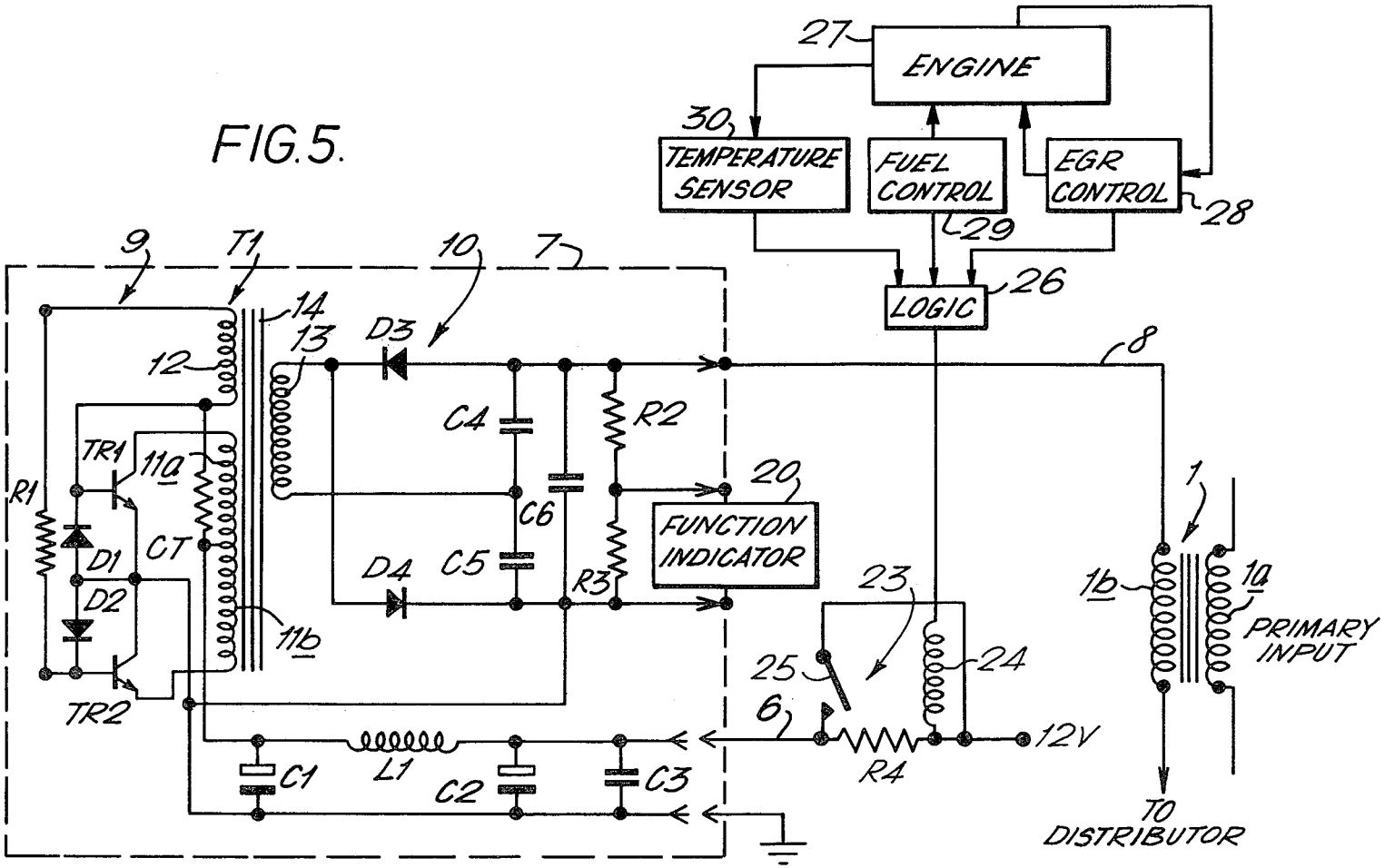
FIGS. 5 to 7 illustrate alternative arrangements to the circuit of FIG. 4.
Figure 6:
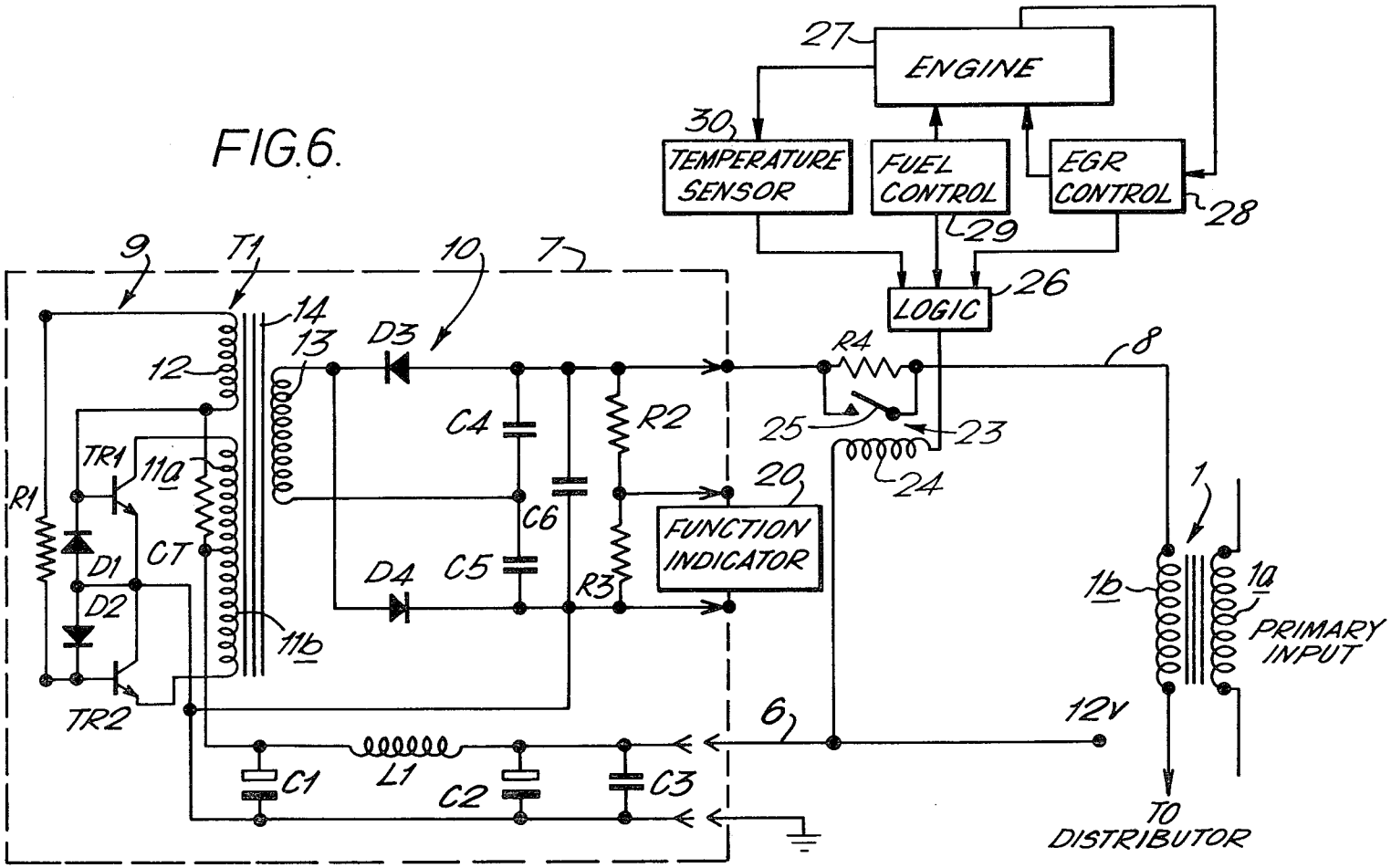
Figure 7:
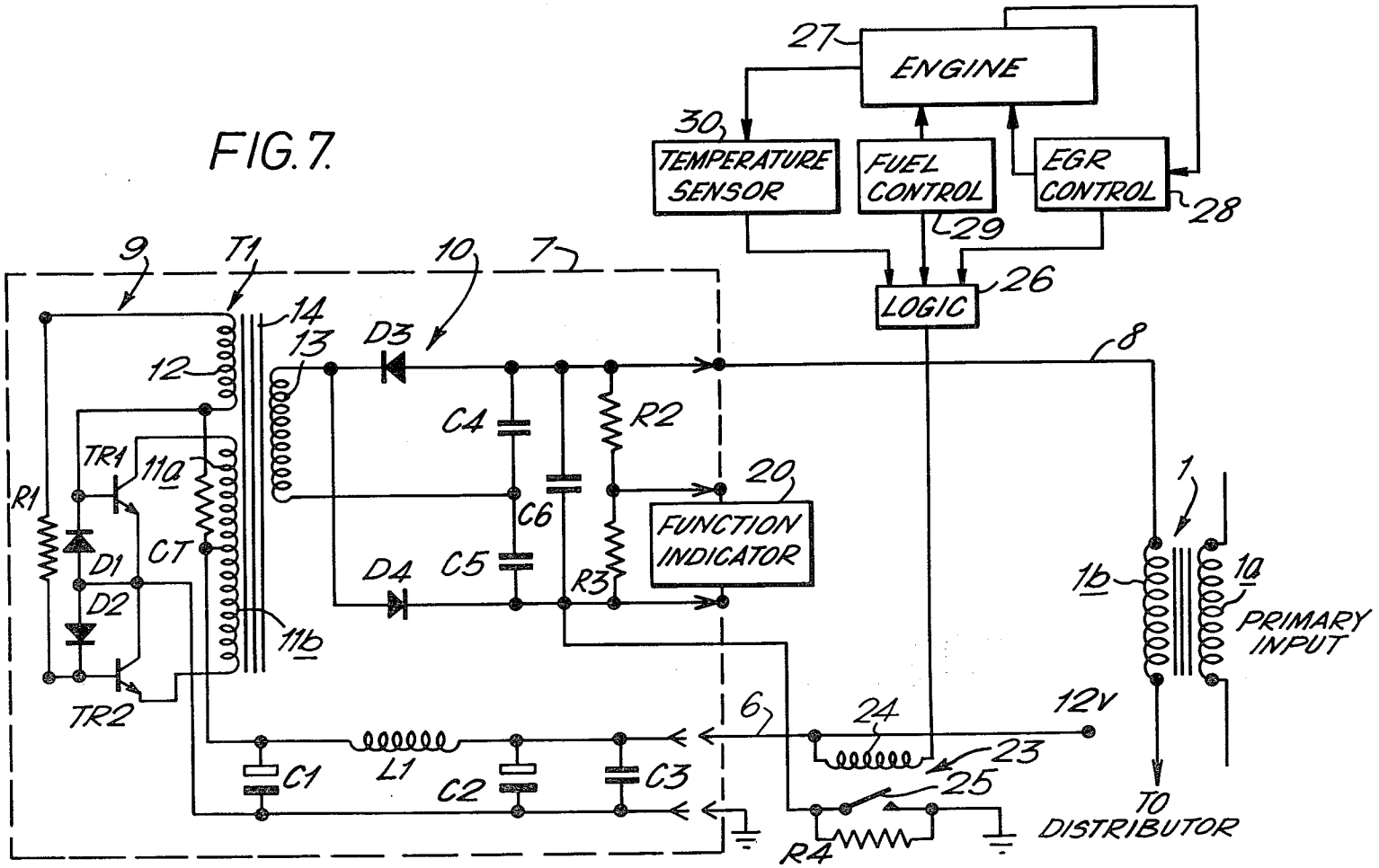

FIGS. 5 to 7 illustrate alternative ways in which the relay 25 can be connected to the d.c. generator 7. In FIG. 5, the dropping resistor R4 is connected in the 12 volt supply rail 6 rather than in the earth return. In FIG. 6, the dropping resistor is connected in the high output voltage line 8 of the generator 7. In FIG. 7 the dropping resistor is connected in the earth reference line of rectifier output stage 10 of the generator.

In the above described embodiments of the invention, the d.c. generator 7 is connected in series with the secondary windings 1*b* of the ignition coil. This arrangement has the advantage that the inductance of the secondary winding 1*b* acts to increase the sustaining voltage above the level set by the generator 7 in response to increased arc impedance that occurs for example during high gas swirl. In certain circumstances, the inductance of the secondary 1*b* may not be sufficient for this purpose and it may be desirable to use a separate inductor to define the ballast.

Figure 8:
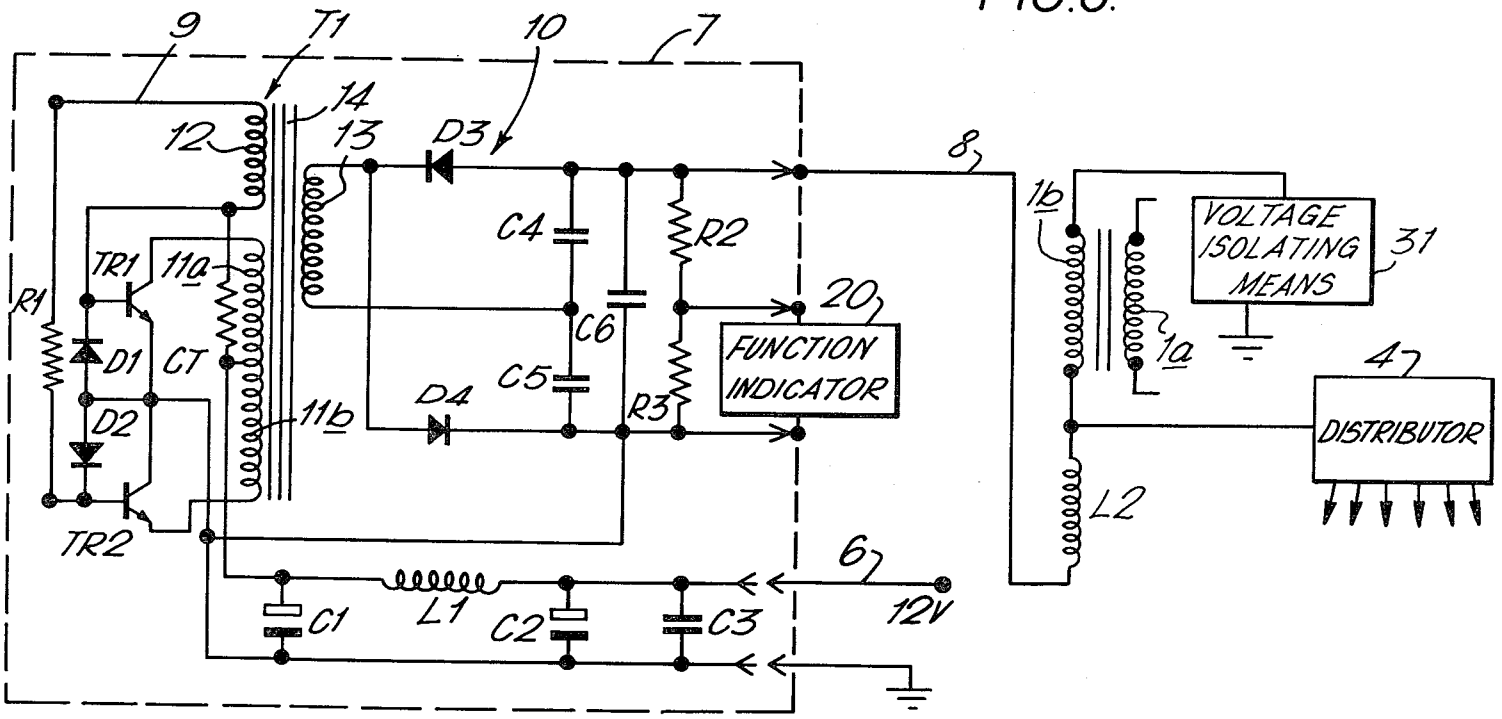
FIG. 8 is a schematic circuit diagram of an arrangement permitting a separate inductance to be connected in series with the spark plugs.

FIG. 8 shows an arrangement in which a separate inductor coil L2 is connected in the line 8 rather than using the coil winding 1*b* as the ballast inductance. A voltage isolating means 31 is provided in series with the coil's secondary winding 1*b* in order to prevent the d.c. current from the generator 7 from flowing through the winding to earth in preference to flowing to the spark plugs through the distributor 4.

The voltage isolating means 31 is also adapted to allow operation of the ignition coil 1 such that a high voltage pulse induced in the secondary winding relative to earth can flow to the spark plugs. The voltage isolating means 31 in one form comprises a capacitor which blocks direct current flow from the generator 7 to earth through the winding 1*b*. The voltage isolating means can also comprise a spark gap across which pulses induced in the seconardy 1*b* will jump, or a high voltage diode.

In the above described embodiments, the ignition coil 1 is shown to have four terminals, two for each winding. Such a coil can be made at low cost by adapting the manufacture of a conventional ignition coil. A conventional ignition coil has three terminals such that one end of each of the primary and secondary windings are provided with a respective terminal and the other ends thereof are connected to a common terminal for connection to earth. If it is desired to use the dc generator 7 as an add-on unit for an existing conventional ignition system, the circuit arrangement as shown in FIG. 9 may be used.

Figure 9:
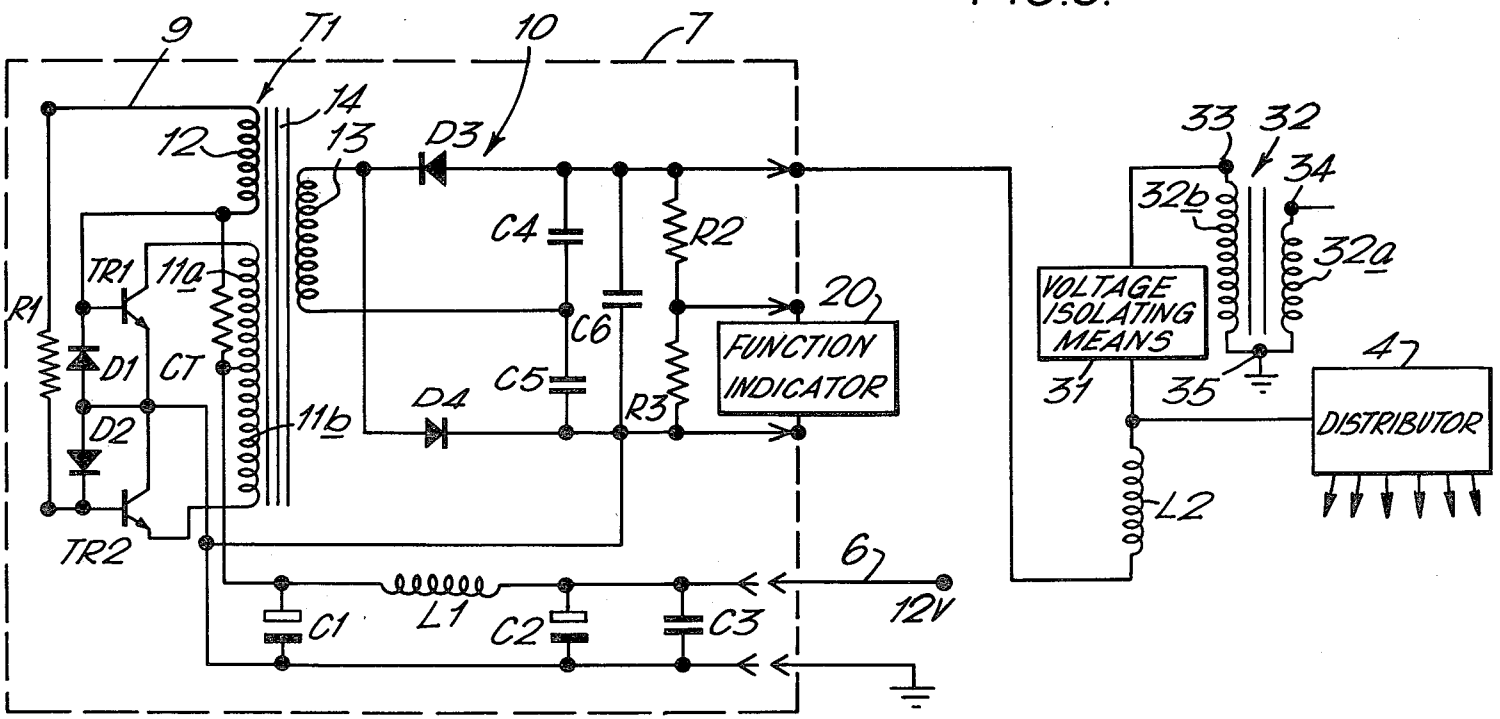
FIG. 9 is a schematic arrangement which allows the d.c. generator to be used as an add-on unit for a conventional ignition system.

In FIG. 9 a conventional three terminal coil 32 is shown, having primary and secondary windings 32*a, b* each with their own terminal 33, 34, and a common earthed terminal 35. The d.c. generator 7 is coupled to the conventional coil and distributor 4 by means of the ballast inductor L2 and the aforesaid voltage isolating means 31 connected in series between the generator 7 and the coil's secondary winding 1*b*. The voltage isolating means 31 serves to direct the current from the generator 7 to the distributor 4 and hence to the spark plugs rather than allowing it to flow through the secondary coil 32*b* to earth. The voltage isolating means 31 however allows the high voltage pulses induced in the winding 32*b* to pass to the distributor 4. As previously stated, the isolating means can for example comprise a capacitor, a spark gap or a diode.

It will be appreciated that different combinations of the circuit features just described can be utilized. For example any of the voltage level switching arrangements shown in FIGS. 4 to 7 could be used with the circuits of FIG. 8 or 9.

The generator 7 thus can be used with conventionally aspirated engines to achieve improvements in fuel economy and pollutant emission reduction, as will be illustrated by example hereinafter, and also provides for similar improvements with engines provided with EGR, which may or may not be conventionally aspirated with a carburettor.

As previously mentioned, one aspect of the invention concerns stratified charge engines and an example of the invention will now be described in relation to the Ford PROCO engine in order to illustrate the advantages achieved thereby.

Development of the Ford PROCO engine can be seen from "Exhaust Emission Control by the Ford Programmed Combustion Process—PROCO" SAE Paper No. 720052 January 1972, and from the previously mentioned SAE Paper No. 780699—"The Ford PROCO Engine Update".

Figure 10:
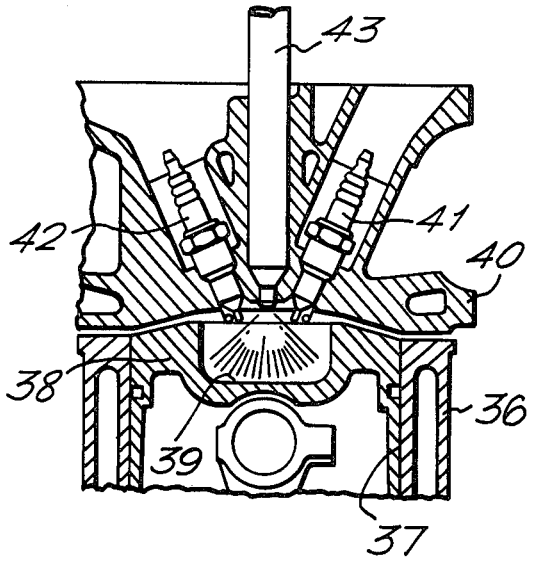
FIG. 10 is a sectional view of a cylinder of a PROCO engine.
Figure 11:
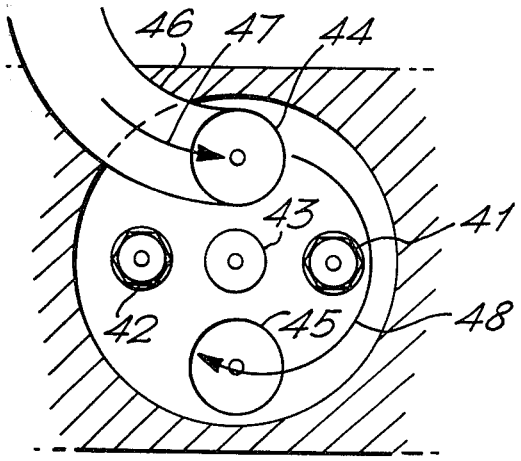
FIG. 11 is a schematic top plan view of the cylinder head of the PROCO engine.

A schematic illustration of the PROCO engine is shown in FIGS. 10 and 11. The engine has a high compression ratio of typically 11:1 and operates with a lean fuel to air ratio of typically 15:1. Referring to FIG. 10, which shows a sectional view of one cylinder of the engine, an engine block 36 is bored with a cylinder 37 which receives a piston 38 formed with a dished combustion chamber 39. A cylinder head 40 is bolted onto the block 36. The head 40 receives two spark plugs 41, 42 and also a fuel injector 43 that injects fuel directly into the cylinder such as to establish a stratified charge therein. The engine has a EGR system (not shown) in order to reduce $NO_x$ emission. The layout of the cylinder head in plan view is shown schematically in FIG. 10, from which it will be seen that the head includes inlet and outlet valves 44, 45 for air and EGR, and an inlet manifold 46. The inlet manifold 46 and the inlet valve are arranged to establish a swirling gas motion within the cylinder, the gas motion being indicated schematically by the arrows 47, 48.

It has been found necessary to use two spark plugs per cylinder with a PROCO engine because unsatisfactory combustion otherwise results at conditions of high load and high EGR. As a result a complex distributor is required and the overall cost of the ignition system is undesirably increased. Also, as can be seen from FIG. 11, the cylinder head 40 becomes rather crowded with components, which makes it difficult to design an engine of this type with a capacity of less than 5 liters, since the size of the head then is too small to receive all of the required components.

I have found that a PROCO engine can be made to run satisfactorily with only one spark plug per cylinder when an ignition system of the kind shown in FIG. 1 is used therewith. Such an arrangement according to the invention is shown in FIG. 12 where it can be seen that the engine has been modified to have only one spark plug 42 which receives a spark initiating pulse from a spark generating means and a spark sustaining voltage thereafter from a d.c. generator, as described with reference to FIG. 1 et seq. The improvement achieved can be seen from the results of a test given below, in which a single cylinder of a PROCO engine was run with (a) two spark plugs (b) one spark plug and (c) one spark plug with the ignition system of the invention, the other plug opening being blanked off. In the results of test (c) the system of the invention is referred to as the BWU ignition system. The test were performed without attempting to optimize the settings of the engine for the BWU system except that a 4° ignition timing retardation was introduced relative to the the optimum setting for the 2 plug PROCO engine. It is believed that further improvements in HC(hydrocarbon) and CO(carbon monoxide) exhaust emissions can be achieved when further optimization of the engine operating parameters is achieved.

TABLE 1

Test Results - 5 Liter PROCO Engine

| Test | 4000 LB I.W. Emissions-GPM | | | 12 P.A.U. Economy | 2.75 Rear Axle |
|---|---|---|---|---|---|
| Type | HC | CO | $No_x$ | MPG | Remarks |
| Cold Start (C/H) | .24 | .6 | .68 | 16.9 | PROCO dual plug baseline |
| Hot Start (H/S) | .11 | .2 | .52 | 17.7 | X-5 plugs, .020" gap, 2 test average |
| C/H | .20 | .3 | .69 | 16.4 | BWU system, X-7 O.B. plug |
| H/S | .12 | .1 | .57 | 16.9 | Dummy I.B. plug, .035" gap, 1 test |
| C/H | .20 | .2 | .59 | 16.5 | BWU system, same as above |
| H/S | .12 | .1 | .50 | 17.2 | Configuration but ignition timing retarded 4° - 2 Test average |
| H/S | .06 | .1 | .74 | 16.0 | PROCO single O.B., X-7, .035" gap. Rough engine, weak drive standard ignition timing |
| H/S | .11 | .2 | .53 | 17.7 | BWU system 4° retard |
| Hot Transient | .33 | .4 | .82 | 17.6 | PROCO, single O.B. ignition, 4° retard |
| Hot Transient | .26 | .4 | .65 | 18.3 | BWU system, 4° retard |

| | Driveability Evaluation | | |
|---|---|---|---|
| | PROCO dual Plug (.020" gap) | PROCO single plug (.035" gap) | BWU system single plug (.035" gap) |
| Cruise | Steady | Slightly Rougher | Steady |
| Medium Load (10" servo vacuum) | Slight Roughness | Noticeably Rough | Steady to slight roughness |
| Heavy Load (5" servo vacuum) | Steady, slight harshness | Noticeably rough/weak | Steady, harsh with standard timing: only slight harshness with 4° retard |

Test Conclusions

1. The BWU system is comparable to the standard PROCO 2 plug system on emissions and has a comparable fuel economy.
2. The BWU system is better than a PROCO single plug system on both emissions and fuel economy.
3. The BWU system is at least as good as the PROCO 2 plug system on driveability and a significant improvement compared to a PROCO single plug system.

The BWU system provides for increased EGR tolerance. On test the standard 2 plug PROCO engine would run to a predetermined minimum misfire rate limit with an EGR flow rate of 66% relative to the flow rate of fresh inlet gas. However with 1 plug and the BWU system, the PROCO ran to 103% EGR before the misfire limit was approached.

As previously mentioned, the ignition system of the invention also provides for substantial fuel economies with conventionally aspirated engines, with or without EGR. Given below in Table 2 is the results of tests performed with three different capacity conventional engines.

TABLE 2

| | Emissions gpm | | | Fuel Consumption | Highway Fuel |
|---|---|---|---|---|---|
| | HC | CO | NOx | (m.p.g.) | Consumption |
| | | | Test 1 2.3 liter engine | | |
| Baseline | .172 | 3.48 | 1.12 | 18.40 | 24.75 |
| BWU Ignition S.H.U. | .160 | 3.17 | 1.16 | 19.81 (+8%) | 25.91 (+5%) |
| BWU Ignition T.O.O. | .301 | 2.29 | 1.82 | 21.09 (+15%) | 28.30 (+14.43%) |
| | | | Test 2 3.3 liter engine | | |
| Baseline | .289 | 1.71 | 1.28 | 18.30 | 23.14 |
| BWU Ignition S.H.U. | .52 | 2.28 | 1.11 | 10.06 (+4%) | 23.57 (+2%) |
| BWU Ignition T.O.O. | .25 | 1.46 | 1.73 | 19.97 (+9%) | 25.03 (+8) |
| | | | Test 3 5.0 liter engine | | |
| Baseline | .383 | 2.15 | .99 | 16.97 | 21.97 |
| BWU Ignition S.H.U. | .341 | 2.32 | .70 | 17.06 (+5%) | 23.35 (+6.28%) |
| BWU Ignition T.O.O. | .347 | 2.48 | .73 | 19.11 (+12.6%) | 24.92 (+10.15%) |

S.H.U.: Straight hook only (no other alterations).
T.O.O.: Timing optimizing only.

The tests were performed over 4,200 miles. The figures in brackets show the overall fuel economy improvement given by the BWU system in percentage terms relative to a baseline defined by a comparable run of the engine with its conventional ignition system.

An advantage of the d.c. generator 7 described with reference to FIG. 2 et seq is that it is eminently suitable to manufacture in mass production. It has a high conversion efficiency of greater than 90% which is achieved with a low component count.

Another practical form of the d.c. generator 7 is shown in FIG. 13. This form of the generator derives the high voltage applied to sustain the sparks, directly from the usual alternator fitted to the engine to power the usual ancillary engine circuits. Referring to FIG. 13, an engine 50 is shown driving an electrical alternator 51 by means of a belt 52, in a conventional manner. The alternating voltage from the alternator 51 is fed to the usual rectifier and voltage regulator shown schematically at 53, which supplies a normal 12 volt d.c. supply to ancillary electrical circuits 54, such as for example the low voltage circuits connected to the primary winding 1*a* of the coil 1. Additionally, and in accordance with the invention, the output of the alternator 51 is fed to an isolating and step up transformer 55 and thence to a rectifying and smoothing circuit comprising a diode D5, a capacitor C7 and a resistor R5. The rectifier arrangement provides an output voltage of nominally 3KV for application on line 8 through the secondary winding of the coil 1*b* to sustain the sparks, in the manner described with reference to FIG. 1.

Optionally, the circuit can include a voltage level switching arrangement, much as described with reference to FIG. 7. Thus, refering to FIG. 13, there is shown a logic circuit 26 which switches current to operate the relay coil 24 and contacts 25 in the manner described with reference to FIG. 7. Thus, normally, the voltage dropping resistor R4 reduces the output voltage on line 8, but when the relay operates to shut the contacts 25, the resistor R4 is shunted and the output voltage on line 8 is increased.

Clearly the arrangement of FIG. 13 and be used with a conventionally aspirated engine, with or without EGR, and can also be used with a stratified charge engine such as the PROCO.

I claim:

1. Apparatus for producing spark ignition of an internal combustion engine wherein combustion is effected by means of a spark plug in a combustion chamber of the engine, comprising:

(a) spark pulse generating means for applying repetitively to the spark plug an electrical pulse capable of initiating a spark across the spark plug; and (b) d.c. to d.c. converter means for producing a continuous constant output voltage for application to the spark plug to sustain the spark, said converter means comprising:

(1) a step up transformer having primary, secondary and feedback windings, and a saturable core;

(2) oscillator means including a pair of semiconductor switching means coupled to said primary winding and to said feedback winding and operable to produce an oscillatory current flow in said primary winding, thereby to induce an oscillatory stepped up voltage in said secondary winding, said oscillator means including a resistor (R1) connecting one end of said feeback winding with the base electrode of one of said semiconductor switching means, the other end of said feedback winding being directly connected with the base electrode of the other of said semiconductor switching means, said resistor being operable to adjust the point at which the bases of the semiconductor switching means no longer saturate, thereby to define the maximum value of current (22) beyond which operation of the oscillator means is automatically terminated; and (3) rectifying means coupled to said secondary winding for producing a rectified output voltage for application to the spark plug;

(4) said converter means being operable upon short circuit of said output voltage to ground to damp said oscillator means and thereby cease operation of said converter means.

2. Apparatus as defined in claim 1, and further including an output capacitor across which a rectifier multiple of said secondary winding voltage is developed in use therefore; and circuit element means defining a resistance path in parallel with said capacitor to allow it to discharge when the circuit is inoperative.

3. Apparatus as defined in claim 1, and further including (c) sensor means for providing an output signal indicative of an operating parameter of the engine; and (d) means responsive to said output signal of the sensor means for controlling the magnitude of the output voltage of said generator means to minimize spark erosion of said spark plug.

4. Apparatus as defined in claim 1, wherein said spark generating means comprises (a) an ignition coil (1) having primary (1*a*) and secondary (1*b*) windings, said secondary winding being adapted for connection with the spark plug;

(b) a source of relatively low supply voltage; and (c) means (2) connected with said low voltage supply for producing in said primary winding a rate of change of current operable to induce in said secondary winding voltage pulses of a magnitude to initiate the production of a spark by the spark plug.

5. Apparatus as claimed in claim 4, wherein said converter means further includes a multiplier stage (10) connected to the output winding of the transformer means to produce a rectified multiple of the oscillatory voltage developed across said secondary winding, an output capacitor (6) arranged to be charged as a function of said rectified multiple voltage produced by the voltage multiplier stage, and resistor elements (R2, R3) connected in parallel with said output capacitor to provide therefor a discharge path when said converter means is inoperative.

6. Apparatus as claimed in claim 5, and further including function indicator means (20) for indicating that said converter is operative.

7. Apparatus as defined in claim 6, wherein said function indicator means comprises a neon tube connected in parallel with said output capacitor.

8. Apparatus as defined in claim 4, and further including sensor means for providing an output indicative of an engine operating parameter, and means responsive to the output of sensor means for controlling the magnitude of the output of said converter means to minimize spark erosion of the spark plug.

9. Apparatus as defined in claim 4, and further including a separate inductor coil L2 connected in series with and between the output of said converter means and the secondary winding of said ignition coil, output conductor means for connecting the junction between said separate inductor coil and said secondary winding with said spark plug, and voltage isolating means permitting said high voltage pulses induced in the secondary winding to pass to said output conductor means, said voltage isolating means also being adapted to cause current from said converter means to flow to said spark plug output conductor means rather than through said secondary winding of the ignition coil.

10. An arrangement as claimed in claim 9 wherein said ignition coil has four terminals each of which is connected to a respective end of said primary and secondary windings, and wherein one terminal of the secondary winding is connected to earth through said voltage isolating means.

11. An arrangement as claimed in claim 9 wherein said ignition coil has three terminals, a first and a second of which are connected to respective ends of said primary and secondary coil windings, the third terminal being connected in common to the other two ends of said windings, said third terminal being earthed, and said voltage isolating means is connected to said second terminal and to said spark plug output.

12. An arrangement as claimed in claim 9 wherein said voltage isolating means comprises electrodes defining a spark gap.

13. An arrangement as claimed in claim 9 wherein said voltage isolating means comprises a diode.

14. An arrangement as claimed in claim 9 wherein said voltage isolating means comprises a capacitor.

15. Apparatus as defined in claim 3, wherein said engine includes an EGR system, and further wherein said sensor means includes means responsive to the EGR rate of the engine.

16. Apparatus as claimed in claim 3 or 14, wherein said sensor means is responsive to the strength of fuel mixture supplied to the engine.

17. Apparatus as claimed in claim 3, wherein said sensor means is responsive to engine temperature.

18. Apparatus as claimed in claim 3, and further including a relatively low voltage supply, said generator means includes d.c. to d.c. converter means including a step up transformer having a primary and a secondary winding, semiconductor switching means coupled to the primary winding of the transformer so as to switch current from said low voltage supply and produce an oscillatory current flow in said transformer primary winding, thereby to induce an oscillatory high voltage in the transformer secondary winding, and rectifying means coupled to said transformer secondary winding for producing a relatively high rectified output voltage for application to the spark plug, voltage dropping impedance means for reducing the voltage produced by said converter means, and switching means responsive to said sensor means for disabling operation of said voltage dropping impedance means.

19. Apparatus as defined in claim 18, wherein said switching means comprises a relay having a coil and switching contacts, said relay coil being energized from said low voltage supply in dependence upon operation of said sensor means, and said voltage dropping means being shunted by said switching contacts.

20. Apparatus as defined in claim 19, wherein said voltage dropping impedance means comprises a resistor connected to reduce the low voltage supply received by the converter means.

21. Apparatus as defined in claim 19, wherein said voltage dropping impedance means comprises a resistor connected to reduce high output voltage produced by said converter means.

* * * * *